United States Patent [19]

Otani et al.

[11] Patent Number: 4,996,183

[45] Date of Patent: Feb. 26, 1991

[54] THERMOSENSITIVE RECORDING MATERIALS

[75] Inventors: Masaaki Otani; Shigetoshi Hiraishi; Kenji Hyodo, all of Tokyo, Japan

[73] Assignee: Mitsubishi Paper Mills, Limited, Tokyo, Japan

[21] Appl. No.: 329,766

[22] Filed: Mar. 28, 1989

[30] Foreign Application Priority Data

May 27, 1988 [JP] Japan ..... 63-131273

[51] Int. Cl.[5] ..... B41M 5/18

[52] U.S. Cl. ..... 503/208; 503/209; 503/214; 503/225

[58] Field of Search ..... 503/208, 209, 214, 225; 427/150-152

[56] References Cited

FOREIGN PATENT DOCUMENTS 56-33483 3/1981 Japan ..... 503/226

59-22792 2/1984 Japan ..... 503/226

*Primary Examiner*—Bruce H. Hess

*Attorney, Agent, or Firm*—Cushman, Darby & Cushman

[57] ABSTRACT

A thermosensitive recording material having a thermosensitive color forming layer containing a specific dispersing agent and binder mixture showing a softening point of at least 70° C. can minimize occurrence of head stain at a thermal head in thermosensitive recording. The combination of sulfonic acid-containing polyvinyl alcohol and polyacrylamide or acrylamide-acrylonitrile copolymer is preferable.

6 Claims, 2 Drawing Sheets

X10,000

X10,000

X 3,500

X 10,000

X 3,500

THERMOSENSITIVE RECORDING MATERIALS

BACKGROUND OF THE INVENTION

1. Field of the Invention

The present invention is directed to thermosensitive recording materials and more particularly, to those which are prepared by dispersing a generally colorless or light colored dye precursor with a dispersing agent, a color developer capable of forming a color of said dye precursor in response to heating with said dispersing agent and a sensitizer together with a dispersing agent, in a finely divided particulate state, mixing each dispersion with a binder, coating the mixture onto a support and drying.

2. Discussion on Related Arts

Thermosensitive recording materials are basically prepared by the following procedures. That is, firstly, a dye precursor, a dye developer and a sensitizer independently or as a mixture thereof is dispersed in water containing a dispersing agent therein and the dispersion is treated with a sand mill, a ball mill, etc. to finely divide those agents, whereby a dispersion composed of finely divided particles is prepared.

Next, a finely divided dye precursor dispersion, a finely divided dye developer dispersion and a finely divided sensitizer dispersion as well as a binder, etc. are thoroughly mixed with stirring. The thus obtained thermosensitive coating liquid is uniformly coated onto a base material such as paper, etc. The system is dried to form a thermosensitive color forming layer. Then, the surface is rendered by supercalendering to give a thermosensitive recording material.

The following properties are required for the dispersing agent and binder used for the aforesaid thermosensitive coating liquid.

(1) The dispersing agent has good compatibility with the binder. And upon mixing a dispersion composed of the dye precursor, color developer and sensitizer with the binder, they are uniformly mixed.

(2) A viscosity of the dispersing agent is not excessively high so as to cause reduction of grinding efficiency of a sand mill, etc. Further they have minimized foamability so that defoaming is rapidly realized.

(3) They have no undesired interaction with the dye precursor, dye developer or sensitizer.

(4) The binder has a high adhesive strength property and shows the sufficient picking strength when formed into a thermosensitive recording material.

Such a dispersing agent and binder are very limited; in many cases, polyvinyl alcohol is used as a main dispersing agent and binder (for example, Japanese Patent Unexamined Publication No. A22792/1984). In some case, for the purpose of further improving the grinding efficiency, a finely divided dye precursor dispersion, a finely divided dye developer dispersion and a finely divided sensitizer dispersion are prepared using a dispersing agent such as styrene-maleic anhydride copolymer which is a water soluble high molecular substance and polyvinyl alcohol is then mixed with these dispersions and the resulting mixture is used.

In the construction described above, however, thermofusible substances are adhered around a heat generating part of the thermal head mounted to a printer, etc., upon color formation of the thermosensitive color forming layer by heating, to injure the thermal head or cause so-called head stain resulting in poor printing quality. For this reason, silicic acid, urea resin pigment or pigments such as light calcium carbonate and the like having a high oil-absorbing property are used in many cases singly or as the admixture thereof, for the purpose of preventing the amount of the hand stain generated. However, as the amount of the pigment added increases, the adverse effects are resulted that a quantity of heat required for elevating to a temperature required enough for printing also increases and further such a reduction of the sensitivity as a color forming density decreases at the same energy applied occurs, etc. Furthermore, it cannot be said that the effect of preventing the head stain reaches a sufficient level yet.

SUMMARY OF THE INVENTION

An object of the present invention is to provide thermosensitive recording materials having minimized occurrence of head stain in thermosensitive recording materials.

The present inventors have found that an amount of head stain can be reduced without reducing sensitivity by providing on a support a thermosensitive color forming layer obtained from a composition comprising a substantially colorless to light colored dye precursor, a color developer capable of forming a color of said dye precursor by reacting with it upon heating and a sensitizer, and a dispersing agent and a binder for these compounds and by setting a softening point of a mixture of the dispersing agent and the binder at 70° C. or more in a thermal instrumental analysis using a thermal analysis system manufactured by Du Pont, TMA Module No. 943 of Model 990.

DETAILED DESCRIPTION OF THE PREFERRED EMBODIMENTS

Figure 1:
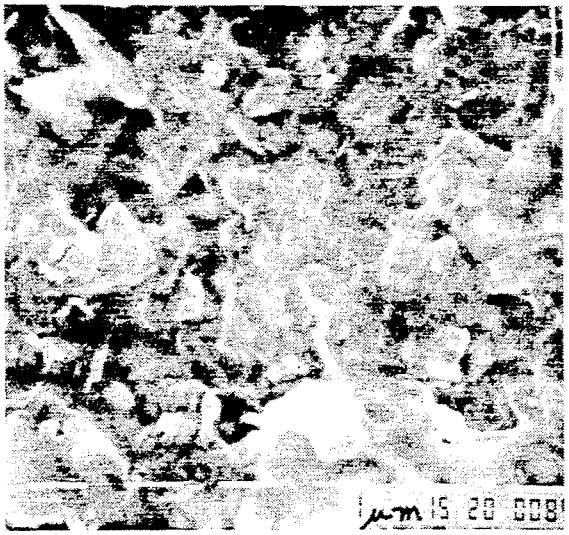
FIG. 1 and FIG. 2 indicate the electron microscopic photography of each surface of thermosensitive recording materials beyond the limits of the present invention after printing and color formation.

The dispersing agent and the binder can be any materials and any combination so long as they have properties described in (1) through (4) above and their combination meets the requirements described above. However, the choice is not simple. Even though a combination wherein either the dispersing agent or the binder or both have the high softening points is simply chosen, the softening point of the resulting mixture is rather lowered in many cases.

For example, in the combination of methyl cellulose and polyvinyl alcohol, both have the softening points of 70° C. or higher but a softening point of the mixture of both whose weight ratio is 1 to 3 becomes 50° C.

It has been found that the various requirements described above are met by a combination with polyacrylamide or with a copolymer of acrylamide and acrylonitrile as the binder, in case that the dispersing agent is sulfonic acid-containing polyvinyl alcohol; by a combination with a copolymer of acrylamide and acrylonitrile as the binder in the case of using methyl cellulose as the dispersing agent; and by a combination with a copolymer of acrylamide and acrylonitrile as the binder in the case of using hydroxyethyl cellulose as the dispersing agent.

It is appropriate that a ratio of the dispersing agent to be added be in a range of 1 to 7% based on the weight of the dye precursor, color developer and sensitizer. When the ratio is less than 1%, a grinding efficiency in a sand mill, etc. decreases. Further with more than 7%, the sensitivity is lowered. A more preferred ratio to be added is in a range of 1 to 3%.

It is appropriate that a ratio of the binder to be added be in a range of 7 to 20%. As the ratio becomes 7% or less, the picking strength of the thermosensitive layer decreases and finally causes troubles that a part of the coated layer stains rolls at the calendering step. Further as the ratio increases, reduction in sensitivity is recognized. When the ratio exceeds 20%, the reduction in sensitivity becomes remarkable.

A more preferred ratio to be added is in a range of 7 to 10%.

For purposes of improving water retention properties or preventing fog, other water soluble high molecular substances may also be incorporated, in addition to the combination of the dispersing agent and the binder of the present invention. Examples of these water soluble high molecular substances are casein, gelatin, starches, modified polyvinyl alcohols, copolymers of ethylene and maleic anhydride and copolymers of isobutylene and maleic anhydride.

In the cases described above, it is required that the softening points of these mixtures should be 70° C. or higher.

In the thermosensitive recording material of the present invention, paper, synthetic paper or a film is usually used as the support. The thermosensitive recording material can be obtained by coating the thermosensitive color forming layer onto the support using a coating apparatus having a coater head such as an air knife, a blade, a roll, etc.

In many cases, 1 or 2 intermediate layers mainly composed of a white to light colored pigment and a binder are provided between the support and the thermosensitive color forming layer, for purposes of reducing head stain and improving sensitivity and printing quality.

As the oil-soluble pigment used for the intermediate layer, such pigments are desired to have the oil absorption index of 60 ml/100 g or more in the measurement method defined in JISK-5101. But pigments showing the index of not greater than 60 ml/100 g may be also used in combination. It is desired that a particle diameter of the pigment should be not greater than 5.0 $\mu$, preferably not greater than 1 $\mu$, in a volume average particle diameter, in view of its smoothness. Specifically the pigment can be chosen from silicic acid, calcium carbonate-coated silicic acid, kaolin, calcined kaolin, talc, agalmatolite, diatomaceous earth, calcium carbonate, aluminum hydroxide, magnesium hydroxide, magnesium carbonate, titanium oxide, barium carbonate, urea-formalin pigment, baloon-like plastic pigment, etc.

Upon coating onto the support, it is general to disperse these pigments together with the dispersing agent and a water soluble high molecular adhesive such as starch derivatives, polyvinyl alcohol, styrene-maleic anhydride, etc., a hydrophobic polymer emulsion such as styrene-butadiene latex, acrylic resin emulsion, etc. to the dispersion.

It is also possible that one or more of the dye precursor, the color developer and the sensitizer be incorporated into the intermediate layer simultaneously.

The thermosensitive color forming layer provided on the intermediate layer is mainly composed of the dye precursor, the color developer, the sensitizer, the binder and the dispersing agent used for finely dividing the foregoing components; if necessary and desired, waxes, metal soap, etc. may also be incorporated for the purposes of preventing head abrasion, sticking, etc. Further the oil-absorbing pigments described above may also be incorporated into the thermosensitive color forming layer.

The dye precursors used in the present invention are not particularly limited so long as they are generally used for pressure-sensitive recording paper or thermosensitive recording paper. Specific examples include the following dye precursors. (1) As triarylmethane compounds, there are 3,3-bis(p-dimethylaminophenyl)-6-dimethylaminophthalide (Crystal Violet lactone), 3,3-bis(p-dimethylaminophenyl)phthalide, 3-(p-dimethylamino-phenyl)-3-(1,2-dimethylindol-3-yl)phthalide, 3-(p-dimethylamino-phenyl)-3-(2-methylindol-3-yl)phthalide, 3-(p-dimethylamino-phenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrrol-2-yl)-6-dimethylaminophthalide, etc.; (2) as diphenylmethane compounds, there are 4,4'-bis-dimethylamino-benzhydryl benzyl ether, N-halophenyl leuco Auramine, N-2,4,5-trichlorophenyl leuco Auramine, etc.; (3) as xanthene compounds, there are rhodamine B anilinolactam, Rhodamine B p-chloroanilinolactam, 3-diethylamino-7-dibenzylaminofluorane, 3-diethylamino-7-octylaminofluorane, 3-diethylamino-7-phenylfluorane, 3-diethylamino-7-(3,4-dichloroanilino)fluorane, 3-diethylamino-7-(2-chloroanilino)fluorane, 3-diethylamino-6-methyl-7-anilinofluorane, 3-piperidino-6-methyl-7-anilinofluorane, 3-ethyl-tolylamino-6-methyl-7-anilinofluorane, 3-ethyl-tolylamino-6-methyl-7-phenethylfluorane, 3-diethylamino-7-(4-nitroanilino)fluorane, 3-dibutylamino-6-methyl-7-anilinofluorane, 3-(N-methyl-N-propyl)amino-6-methyl-7-anilinofluorane, 3-(N-ethyl-N-isopropyl)amino-6-methyl-7-anilinofluorane, 3-(N-ethyl-N-tetrahydrofurfuryl)-amino-6-methyl-7-anilinofluorane, etc.; (4) as thiazine compounds, there are benzoyl leuco methylene blue, p-nitrobenzoyl leuco methylene blue, etc.; (5) as spiro compounds, there are 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methylnaphtho(3-methoxybenzo)spiropyran, 3-propyl-spiro-dibenzopyran, etc. or a mixture thereof.

These dye precursors may be chosen depending upon the utility and desired properties.

As the color developers, acidic substances generally used for thermosensitive recording materials, that is, electron accepting compounds are used; in particular, phenol derivatives and aromatic carboxylic acid derivatives are used. Specific examples of phenol derivatives are phenol, p-t-butylphenol, p-phenylphenol, 1-naphthol, 2-naphthol, p-hydroxyacetophenone, 2,2'-dihydroxybiphenyl, 4,4'-isopropylidenediphenol, 4,4'-isopropylidene-bis(2-t-butylphenol), 4,4'-isopropylidene-bis(2-chlorophenol), 4,4'-cyclohexylidenediphenol, 2,2'-bis(4-hydroxyphenyl)butane, 2,2'-bis(4-hydroxyphenyl)pentane, 2,2'-bis(4-hydroxyphenyl)hexane, methyl diphenolacetate, bis(4-hydroxyphenyl)sulfone, bis(3-allyl-4-hydroxyphenyl)sulfone, 4-hydroxy-4'-methyldiphenylsulfone, 4-hydroxy-4'-isopropyloxydiphenylsulfone, bis(4-hydroxyphenyl)sulfide, 4,4'-thiobis(2-t-butyl-5-methylphenol), 7-bis(4-hydroxyphenylthio)-3,5-dioxyheptane, novolak phenol resin, etc.; examples of the aromatic carboxylic derivatives include benzoic acid, p-t-butylbenzoic acid, methyl p-hydroxybenzoate, isopropyl p-hydroxybenzoate, benzyl p-hydroxybenzoate, lauryl gallatea, stearyl gallate, salicylanilide, 5-chlorosalicylanilide, metal salts such as zinc 5-t-butylsalicylate, etc.; metal salts such as zinc hydroxynapthoate, etc.

Examples of the waxes include paraffin wax, carnauba wax, microcrystalline wax, polyethylene wax; and higher fatty acid amides such as stearic amide, ethylenebis-stearamide, higher fatty acid esters, etc.

Examples of the metal soap include higher fatty acid polyvalent metal salts such as zinc stearate, aluminum stearate, calcium stearate, zinc oleate, etc.

The sensitizer is a compound having a sharp melting point between 80° and 140° C. having good thermal response; specific examples are esters of benzoic acid or terephthalic acid, naphthalenesulfonic acid esters, naphthyl ether derivatives, anthryl ether derivatives, aliphatic ethers and other sensitizers such as phenanthrenes, fluorenes, etc. In addition, the aforesaid waxes can also be used as the sensitizer.

In the thermosensitive recording material, a thermal head mounted to a thermal printer, etc. is pressed to apply an electric current to heat-generating dots and to heat them, whereby a color is formed. In this case, thermofusible substances such as the dye precursor or the like are adhered around a heat generating part of the thermal head to cause so-called head stain. However, by setting the softening point of the mixture of the dispersing agent and the binder at a temperature higher than the definite one, head stain can be markedly reduced. The present invention has thus been accomplished.

In case that a ratio of the pigment to be incorporated generally for the purpose of reducing occurrence of head stain is small, the occurrence of head stain becomes remarkable. When a softening point of the mixture composed of the dispersing agent and the binder is 70° C. or higher, head stain hardly occurs even if no pigment is added. However, as the softening point gets lower, the occurrence of head stain increases. When the softening point is not greater than 65° C., its occurrence is remarkably large.

Mechanism in which a difference is noted in the occurrence of head stain is not fully clear. But it is believed that the major mechanism would be that the dispersing agent and the binder would function as pillars for hindering the thermal head from contacting with the fused thermofusible compounds.

Figure 2:
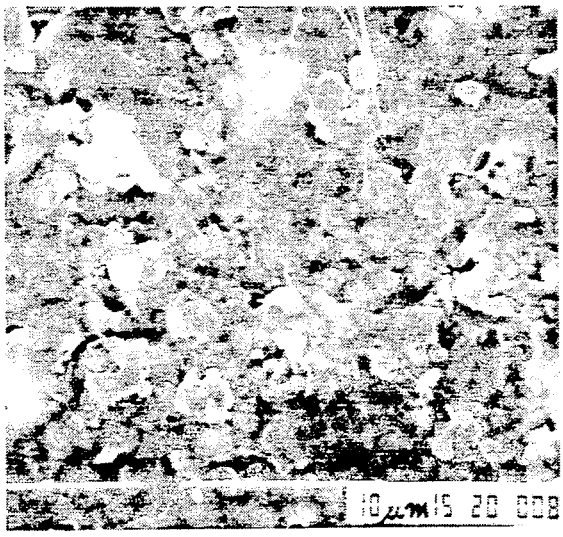

FIGS. 1 and 2 indicate electron microscopic photographies of thermosensitive recording materials at the color forming portions thereof: wherein each thermosensitive recording material comprises an intermediate layer and a thermosensitive color forming layer having no pigment; as a dispersant, 5% of sulfonic acid-containing polyvinyl alcohol whose softening point is 35° C. is applied to the dye precursor, the color developer, and the sensitizer, respectively; as a binder, 10% of polyvinyl alcohol whose softening point is 70° C. is applied to respectively; the softening point is 60° C. of the mixture of the dispersant and the binder, when printed on Sample No. 3 (Comparative Example 1) in EXAMPLES.

(Printing was performed using a printing device, TH-PMD manufactured by Okura Electric Co., Ltd. (Osaka), in which a resistance of a thermal head was 185 ohm; a dot density was 8 dots/mm; a voltage applied was 11 V; a time for applying current was 1.3 ms.).

Figure 3:
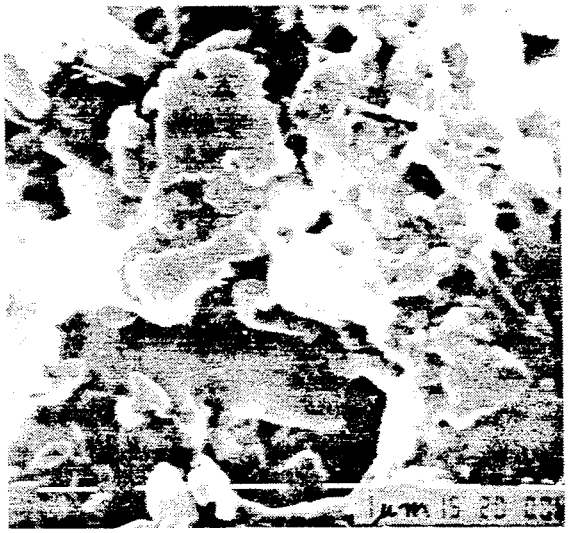
FIG. 3 and FIG. 4 indicate the electron microscopic photography of each surface of thermosensitive recording materials of the present invention after printing and color formation.
Figure 4:
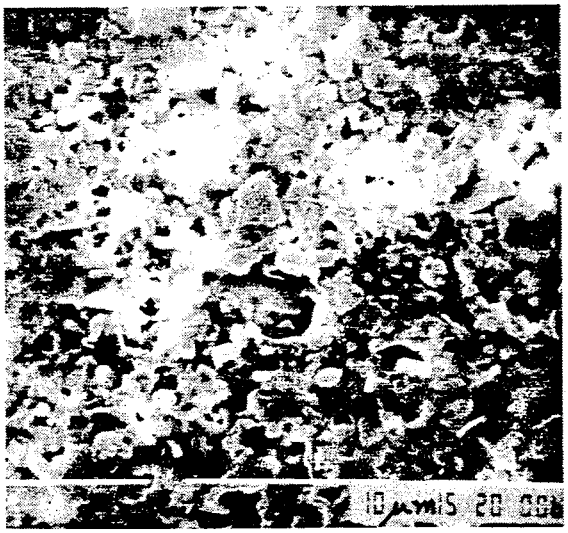

FIGS. 3 and 4 indicate electron microscopic photographies of thermosensitive recording materials similar to those shown in FIGS. 1 and 2, at the color forming portions of Sample No. 6 (Example), in EXAMPLES, wherein the binder in the thermosensitive layer was replaced by polyacrylamide having a softening point of 86° C. instead of polyvinyl alcohol. A softening point of the resulting mixture was 80° C.

In FIGS. 3 and 4, it is believed that a layer of the binder would be formed. Structures such as pedestals, the top of which is viewed flat or pillars, are remarkably observed and gaps therebetween are viewed to be spaces. That it, the organic fusible matters as the dye precursor, etc. that had existed therebetween are viewed to be absorbed into the intermediate layer.

It is considered that such structures as pillars would have the function to hinder a thermal head from contacting with the fused dye precursor, the color developer and the sensitizer and to facilitate transferring the fused dye precursor, etc. into the intermediate layer and mixing them.

On the other hand, in FIGS. 1 and 2, the organic melts containing the binder fused or softened cover the surface of the intermediate layer. It is considered that such a structure would facilitate the contact of the fused dye precursor, etc. with a thermal head and hinder the dye precursor, etc. from transferring into the intermediate layer; such would be disadvantageous for preventing the occurrence of head stain.

EXAMPLES

Next, the present invention will be described in more detail by referring to the examples, wherein parts and % are all by weight.

EXAMPLE 1

Preparation of intermediate layer-coated paper

| | |
|---|---|
| Calcined kaolin (ANSILEX made by Engelhardt Co.) | 100 parts |
| Sodium hexametaphosphate | 0.8 part |
| 48% Styrene-butadiene latex (JSR 0692, made by Nippon Synthetic Chemical Co., Ltd.) | 130 parts |
| Water | 130 parts |

The above components were dispersed with a homogenizer and 25 parts of 20% phosphated starch (MS-4600, Japan Maize Products Co., Ltd.) was added thereto. After thoroughly mixing, the mixture of 6 g/m$^2$ in a solid content was coated onto wood free paper weighing 40 g/m$^2$ and dried.

(1) Preparation of dye precursor dispersion . . . Suspension A

| | |
|---|---|
| 3-Diethylamino-6-methyl-7-anilinofluorane | 1 part |
| 10% Sulfonic acid-containing polyvinyl alcohol aqueous solution | 0.5 part |
| Water | 3.5 parts |

The mixture was ground into a mean particle diameter of 2 μ with a bead mill.

(2) Preparation of color developer dispersion . . . Suspension B

| | |
|---|---|
| 2,2-Bis(4-hydroxyphenyl)propane | 1 part |
| 10% Sulfonic acid-containing polyvinyl alcohol aqueous solution | 0.5 part |
| Water | 3.5 parts |

The mixture was ground into a mean particle diameter of 2 μ with a bead mill.

(3) Preparation of sensitizer dispersion . . . Suspension C

| | |
|---|---|
| 2-Benzyloxynaphthalene | 1 part |
| 10% Sulfonic acid-containing polyvinyl alcohol aqueous solution | 0.5 part |
| Water | 3.5 parts |

The mixture was ground into a mean particle diameter of 2 μ with a bead mill.

(4) Formation of thermosensitive color forming layer:

| | |
|---|---|
| Suspension A | 15 parts |
| Suspension B | 20 parts |
| Suspension C | 25 parts |
| 10% Polyvinyl alcohol aqueous solution | 12 parts |
| Water | 8 parts |

These were mixed and stirred to prepare a coating liquid. The coating liquid was applied onto paper having provided thereon an intermediate layer in a dye precursor amount of 0.5 g/m$^2$ followed by drying. Next, the surface of the thermosensitive color forming layer was subjected to a supercalendering treatment to show BEKK smoothness index varied between 400 and 500 sec. Thus, a thermosensitive recording material was obtained. This material is named Sample No. 3 (Comparative Example).

Sample No. 1 (Comparative Example), Sample No. 2 (Comparative Example, Sample No. 4 (Comparative Example), Sample No. 6 (Example) and Sample No. 7 (Example) were obtained in a manner similar to Sample No. 3 (Comparative Example), except that 10% low molecular polyacrylamide aqueous solution, 10% carbonyl-containing polyvinyl alcohol aqueous solution, 10% isobutylene-maleic anhydride-styrene copolymer aqueous solution, 10% polyacrylamide aqueous solution and 10% acrylamide and acrylonitrile copolymer aqueous solution were used of the same quantity instead of 10% polyvinyl alcohol aqueous solution as the binder aqueous solution in (4) Formation of thermosensitive color forming layer. 10% High molecular aqueous solutions used and Sample numbers are shown in Table 1.

Sample No. 5 (Example) was obtained in a manner similar to Sample No. 6 (Example) except that 5% polyacrylamide aqueous solution was used instead of 10% polyacrylamide aqueous solution in (4) Formation of thermosensitive color forming layer.

Sample No. 8 (Comparative Example) was obtained in a manner similar to Sample No. 3 (Comparative Example) except that 10% methyl cellulose aqueous solution was used instead of 10% sulfonic acid-containing polyvinyl alcohol aqueous solution used as the dispersing agent aqueous solution in the preparation of each of the dispersions of (1) dye precursor, (2) color developer and (3) sensitizer. Sample No. 12 (Comparative Example) was obtained in a manner similar to Sample No. 3 (Comparative Example) except that 10% hydroxyethyl cellulose aqueous solution was used instead of said solution described in the case of Sample No. 8.

Further, a manner similar to Sample No. 8 (Comparative Example) was repeated to obtain Sample No. 9 (Comparative Example) except that 10% polyacrylamide aqueous solution was used instead of 10% polyvinyl alcohol aqueous solution in (4) Formation of thermosensitive color forming layer, to obtain Sample No. 10 (Example) except that 5% acrylamide-acrylonitrile copolymer aqueous solution was used instead, and to obtain Sample No. 11 (Example) except that 10% acrylamide-acrylonitrile copolymer aqueous solution was used instead.

Furthermore, Sample No. 13 (Example) was obtained in a manner similar to Sample No. 12 (Comparative Example) except that 10% acrylamide-acrylonitrile copolymer aqueous solution was used instead of 10% polyvinyl alcohol aqueous solution in (4) Formation of thermosensitive color forming layer.

The compounds of foregoing samples are all shown in Table 1 as a list.

With respect to the above samples, printing was performed with a printing device TH-PMD. Reflection density at the printed portion was measured with a Macbeth densitometer. Furthermore, an amount of head stain adhered to the thermal head was examined by the microscopic observation and evaluated. The results are shown in Table 1. The dispersing agent and the binder were mixed with each other based on the ratio of the weight added actually. And a softening point of the mixture was measured by a film equivalent to 0.0247 g/m$^2$ (when air dried). Test methods will be described layer collectively. The results are also shown in Table 1.

TABLE 1

| Sample No. | Component: Dispersing Agent | Component: Binder | Ratio Based on Color Developer and Sensitizer: Dispersing Agent | Ratio Based on Color Developer and Sensitizer: Binder | Softening Point: Dispersing Agent:Binder | Softening Point: Softening Point (°C.) | Color Density | Head stain |
|---|---|---|---|---|---|---|---|---|
| 1 Comparative Example | Sulfonic acid-containing PVA | PAM(A) | 5% | 10% | 1:2 | 43 | 1.22 | 5 |
| 2 Comparative Example | Sulfonic acid-containing | PVA-AA | " | " | " | 34 | 1.23 | 5 |

TABLE 1-continued

| Sample No. | Component: Dispersing Agent | Component: Binder | Ratio Based on Color Developer and Sensitizer: Dispersing Agent | Ratio Based on Color Developer and Sensitizer: Binder | Softening Point: Dispersing Agent:Binder | Softening Point: Softening Point (°C.) | Color Density | Head stain |
|---|---|---|---|---|---|---|---|---|
| 3 Comparative Example | PVA Sulfonic acid-containing | PVA | " | " | " | 60 | 1.25 | 4 |
| 4 Comparative Example | PVA Sulfonic acid-containing | IB-M-ST | " | " | " | 38 | 1.22 | 5 |
| 5 Example | PVA Sulfonic acid-containing | PAM | " | 5% | 1:1 | 75 | 1.26 | 2 |
| 6 Example | PVA Sulfonic acid-containing | PAM | " | 10% | 1:2 | 80 | 1.26 | 1 |
| 7 Example | PVA Sulfonic acid-containing | PAM-AN | " | " | " | 75 | 1.27 | 1.5 |
| 8 Comparative Example | PVA MC | PVA | " | " | " | 50 | 1.25 | 4 |
| 9 Comparative Example | MC | PAM | " | " | " | 55 | 1.25 | 4 |
| 10 Example | MC | PAM-AN | " | 5% | 1:1 | 80 | 1.29 | 1 |
| 11 Example | MC | PAM-AN | " | 10% | 1:2 | 80 | 1.28 | 1 |
| 12 Comparative Example | HEC | PVA | " | " | " | 45 | 1.25 | 4 |
| 13 Example | HEC | PAM-AN | " | " | " | 70 | 1.26 | 2 |

Sulfonic acid-containing PVA L-3266 Nippon Synthetic Chemical Industry Co., Ltd.
MC (methyl cellulose) SM-15 Shin-Etsu Chemical Industry Co., Ltd.
HEC (hydroxyethyl cellulose) AL-15 Fuji Chemical Co., Ltd.
PAM(A) (low molecular polyarcylamide)
PVA-AA (vinyl alcohol-acrylic acid copolymer) HSB-2450 Sanyo Chemical Co., Ltd.
PVA (polyvinyl alcohol) NM-11 Nippon Synthetic Chemical Industry Co., Ltd.
IB-M-St (isobutylene-maleic anhydride-styrene copolymer) S-28 Idemitsu Petrochemical Co., Ltd.
PAM (polyacrylamide) KE-346 Goou Chemical Industry Co., Ltd.
PAM-AN (acrylamide-acrylonitrile copolymer) B-042 Showa Denko K.K.

Test Methods

[Softening point]

Definite amounts of aqueous solutions of the dispersing agent and the binder are taken and thoroughly mixed with each other. The mixture is taken in a Petri dish in an amount, after air-dried, of 0.0247 g/m$^2$ and dried in a thermostat drier at 40° C. for 8 hours or more to obtain a sample for measurement.

A softening point is measured by the thermal equipment analysis using TMA Module No. 943 of the thermal analysis system, Model 990, manufactured by Du Pont under such conditions as follows: in a room at 25° C., at the temperature elevation rate of 10° C./min, the pressure needle diameter of 2.5 mm and the load of 10 g.

[Printing]

Printing was performed with a printing device, TH-PMD manufactured by Okura Electric Co., Ltd. (Osaka), under such conditions as follows: the resistance of a thermal head was 185 ohm; the dot density was 8 dots/mm; the voltage applied was 11 V; and the time for applying current was 1.3 ms. [Color density]

Reflection density was measured with a Macbeth densitometer.

[Head stain]

Observation was made visually and microscopically around the heat-generating portion of the thermal head by which printing was finished, and evaluation was made in 5 stages.

Criteria are as follows.

1 . . . Adherence of head stain is hardly noted even by microscopic observation; practically good.

2 . . . An amount of head stain adhered was extremely slight; within the limits of practical use.

3 . . . An amount of head stain adhered is between Evaluations 1 and 5; practically no good.

4 . . . An amount of head stain adhered is second largest to Evaluation 5. And the head stain are visually noted clearly; not practically usable.

5 . . . An amount of head stain adhered is the largest.

EXAMPLE 2

In (4) Formation of thermosensitive color forming layer of Sample No. 3 (Comparative Example) in Example 1:

| | |
|---|---|
| Suspension A | 15 parts |
| Suspension B | 20 parts |
| Suspension C | 25 parts |
| Calcined kaolin (ANSILEX, made by Engelhardt Co., Ltd.) | 2 parts |
| Light calcium carbonate (UNIBA 70, manufactured by Shiroishi Calcium Co., Ltd.) | 3 parts |
| 10% Polyvinyl alcohol aqueous solution | 17 parts |

-continued

| | |
|---|---|
| Water | 50.3 parts |

were mixed and stirred to prepare a coating liquid. The coating liquid was applied onto wood free paper weighed 40 g/m$^2$, instead of paper having provided thereon an intermediate layer in the dye precursor amount of 0.55 g/m$^2$ followed by drying. Next, the surface of the thermosensitive color forming layer was subjected to a supercalendering treatment to show BEKK smoothness index varied between 400 and 500 sec. Thus, a thermosensitive recording material was obtained.

This material is named Sample No. 14 (Comparative Example).

Next, Sample No. 15 (Example) was obtained in a manner similar to Sample No. 14 (Comparative Example), except that 10% polyacrylamide aqueous solution was used instead of 10% polyvinyl alcohol aqueous solution.

After printing, color density of the sample was measured and head stain was examined.

The results are shown in Table 2.

TABLE 2

| Sample No. | Ratio of Dispersing Agent to Binder | Softening Point (°C.) of Mixture Based on Weight Ratio in the Preceding Column | Color Density | Head Stain |
|---|---|---|---|---|
| 14 Comparative Example | 2.6:7.4 | 65 | 1.25 | 3 |
| 15 Example | 2.6:7.4 | 79 | 1.28 | 1 |

As is evident from Table 1, in case of the softening point of the combination of the dispersing agent and the binder being 70° C. or higher, an amount of head stain occurred is reduced to a practical level even though a pigment generally incorporated into the thermosensitive color forming layer for the purpose of reducing the amount of head stain occurred is omitted.

Further as shown in Table 2, it is noted that the level of head stain is improved in case of incorporating the pigment. It is turned out that the present invention is still effective.

While the invention has been described in detail and with reference to specific embodiments thereof, it is apparent to one skilled in the art that various changes and modifications can be made therein without departing from the spirit in the scope of the present invention.

What is claimed is:

1. A thermosensitive recording material comprising a support having provided thereon a thermosensitive color forming layer comprising a dye cursor, a color developer for said dye precursor, a sensitizer, a dispersing agent and a binder, a softening point of a mixture of said dispersing agent and said binder being at least 70° C.; said dispersing agent being present in an amount of 1 to 7% by weight based on total weight of said dye precursor, color developer and sensitizer and said binder being present in an amount of 7 to 20% by weight based on total weight of said dye precursor, color developer and sensitizer, and said binder being present in an amount of 7 to 20% by weight based on total weight of said dye precursor, color developer and sensitizer, respectively.

2. A thermosensitive recording material of claim 1, wherein said dispersing agent is sulfonic acid-containing polyvinyl alcohol and said binder is polyacrylamide or a copolymer or acrylamide and acrylonitrile.

3. A thermosensitive recording material of claim 1, wherein said dispersing agent is methyl cellulose and said binder is a copolymer of acrylamide and acrylonitrile.

4. A thermosensitive recording material of claim 1, wherein said dispersing agent is hydroxyethyl cellulose and said binder is a copolymer of acrylamide and acrylonitrile.

5. A thermosensitive recording material of claim 1, wherein a pigment is further added to said thermosensitive color forming layer.

6. A thermosensitive recording material of claim 1, wherein an intermediate layer is provided between said support and said thermosensitive color forming layer.

* * * * *